US008007253B2

(12) United States Patent
Dooley

(10) Patent No.: US 8,007,253 B2
(45) Date of Patent: Aug. 30, 2011

(54) PUMP AND METHOD

(75) Inventor: Kevin Allan Dooley, Mississauga (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 225 days.

(21) Appl. No.: 12/207,574

(22) Filed: Sep. 10, 2008

(65) Prior Publication Data

US 2009/0010752 A1 Jan. 8, 2009

Related U.S. Application Data

(62) Division of application No. 11/564,939, filed on Nov. 30, 2006, now Pat. No. 7,438,538.

(51) Int. Cl.
*F04B 35/04* (2006.01)

(52) U.S. Cl. ..... 417/353; 417/370; 415/72

(58) Field of Classification Search ..... 417/307, 417/356, 423.1, 352, 353, 369, 370, 423.12; 415/71–75

See application file for complete search history.

(56) References Cited

U.S. PATENT DOCUMENTS

| | | | | |
|---|---|---|---|---|
| 2,225,338 | A | 4/1938 | Giess | |
| 2,500,400 | A | 3/1950 | Cogswell | |
| 2,953,993 | A | 9/1960 | Strickland et al. | |
| 3,220,349 | A * | 11/1965 | White | 417/357 |
| 3,220,350 | A | 11/1965 | White | |
| 3,225,698 | A * | 12/1965 | Spisiak | 417/369 |
| 3,288,073 | A | 11/1966 | Pezzillo | |
| 3,373,690 | A | 3/1968 | Unger | |
| 3,413,925 | A | 12/1968 | Campolong | |
| 3,697,190 | A | 10/1972 | Haentjens | |
| 3,870,433 | A | 3/1975 | Raikov et al. | |
| 3,972,653 | A | 8/1976 | Travis et al. | |
| 3,986,551 | A | 10/1976 | Kilpatrick | |
| 4,408,966 | A | 10/1983 | Maruyama | |
| 4,415,308 | A | 11/1983 | Maruyama et al. | |
| 4,470,752 | A | 9/1984 | Teruo et al. | |
| 5,049,134 | A | 9/1991 | Golding et al. | |
| 5,088,899 | A | 2/1992 | Blecker et al. | |
| 5,129,795 | A * | 7/1992 | Hyland | 417/423.12 |
| 5,152,663 | A | 10/1992 | Peroaho et al. | |
| 5,505,594 | A | 4/1996 | Sheehan | |
| 5,507,629 | A | 4/1996 | Jarvik | |
| 5,692,882 | A | 12/1997 | Bozeman, Jr. et al. | |
| 6,068,454 | A | 5/2000 | Gaston et al. | |
| 6,071,091 | A | 6/2000 | Lemieux | |
| 6,071,092 | A | 6/2000 | Casaro et al. | |
| 6,201,329 | B1 | 3/2001 | Chen | |
| 6,227,820 | B1 | 5/2001 | Jarvik | |
| 6,368,075 | B1 | 4/2002 | Fremerey | |
| 6,450,785 | B1 | 9/2002 | Delby et al. | |
| 6,454,547 | B1 | 9/2002 | Kohlhaas et al. | |

(Continued)

OTHER PUBLICATIONS

European Search Report dated Feb. 18, 2011 issued by the European Patent Office with respect to Applicant's corresponding European application No. EP 05815371.9-1267/1834097.

*Primary Examiner* — Charles G Freay
*Assistant Examiner* — Patrick Hamo
(74) *Attorney, Agent, or Firm* — Norton Rose OR LLP

(57) ABSTRACT

A pump for moving a liquid including a rotor rotatable within a housing and slidable relative to the housing between a first axial rotor position during normal pump operation and a second axial rotor position during a pump inoperative condition.

5 Claims, 6 Drawing Sheets

U.S. PATENT DOCUMENTS

| | | | | |
|---|---|---|---|---|
| 6,692,225 | B2 | 2/2004 | Lin | |
| 6,716,157 | B2 | 4/2004 | Goldowsky | |
| 6,832,888 | B2 | 12/2004 | Kabasawa et al. | |
| 6,884,043 | B2 * | 4/2005 | Kimberlin et al. | 417/355 |
| 7,226,277 | B2 | 6/2007 | Dooley | |
| 2004/0241019 | A1 | 12/2004 | Goldowsky | |
| 2007/0086902 | A1 | 4/2007 | Dooley | |
| 2007/0092382 | A1 | 4/2007 | Dooley | |
| 2007/0098572 | A1 | 5/2007 | Dooley | |

* cited by examiner

PUMP AND METHOD

CROSS-REFERENCE TO RELATED APPLICATIONS

This is a Division of Applicant's U.S. patent application Ser. No. 11/564,939 filed on Nov. 30, 2006 (which was a Continuation of Applicant's U.S. patent application Ser. No. 11/017,797, filed on Dec. 22, 2004).

FIELD OF THE INVENTION

The present invention relates to a pump used for pumping a liquid.

BACKGROUND OF THE INVENTION

Electrically driven helix-type pumps are known. Permanent magnet pumps are also known. For example, a centrifugal blood pump is disclosed in U.S. Pat. No. 5,049,134 and an axial blood pump is disclosed in U.S. Pat. No. 5,692,882. In general, these and other helix pumps rely on friction or fluid dynamic lift to move fluid axially though the pump. That is, although the helix rotates, the liquid is rotationally relatively stationary as it moves axially along the length of the pump. While perhaps suited for pumping blood and other low speed and low pressure application, these devices are unsuitable for other environments, particularly where high speed and high pressures are desired. Room for improvement is therefore available.

SUMMARY OF THE INVENTION

One object of the present invention is to provide an improved pump.

In accordance with one aspect of the present invention, there is provided a pump having at least one inlet and one outlet for use in a liquid circulation system, the liquid having a dynamic viscosity, the circulation system in use having a back pressure at the pump outlet, the pump comprising a rotary rotor and a stator providing first and second spaced-apart surfaces defining a generally annular passage therebetween, the passage having a central axis and a clearance height, the clearance height being a radial distance from the first surface to the second surface, the rotor in use adapted to rotate at a rotor speed, at least one thread mounted to the first surface and extending helically around the central axis at a thread angle relative to the central axis, the thread having a height above the first surface and a thread width, the thread height less than the clearance height, the thread width together with a thread length providing a thread surface area opposing the second surface, wherein the rotor, in use, rotates at a rotor speed relative to the stator which results in a viscous drag force opposing rotor rotation, said drag force caused by shearing in the liquid between the thread and first surface and the second surface, the viscous drag force having a corresponding viscous drag pressure, wherein the thread height, thread surface area and thread angle are adapted through their sizes and configurations to provide a viscous drag pressure substantially equal to the back pressure, and wherein the clearance height is sized to provide for a non-turbulent liquid flow between the first and second surfaces.

In another aspect, the present invention provides a method of sizing a pumping system, the system including at least one pump and a circulation network for circulating a liquid having a dynamic viscosity, the circulation system having a back pressure at an outlet of the pump, the pump having a rotary rotor and a stator providing first and second spaced-apart surfaces defining a generally annular passage therebetween, the passage having a central axis and a clearance height, the clearance height being a radial distance from the first surface to the second surface, the rotor in use adapted to rotate at a rotor speed, at least one thread mounted to the first surface and extending helically around the central axis at a thread angle relative to the central axis, the thread having a height above the first surface and a thread width, the method comprising the steps of determining the back pressure for a desired system configuration and a given liquid, dimensioning pump parameters so as to provide a non-turbulent flow in the passage during pump operation, selecting thread dimensions to provide a drag pressure in response to rotor rotation during pump operation, and adjusting at least one of back pressure and a thread dimension to substantially equalize drag pressure and back pressure for a desired rotor speed during pump operation.

In another aspect, the present invention provides a pump for a liquid, the pump comprising a stator including at least one electric winding adapted, in use, to generate a rotating electromagnetic field, a rotor mounted adjacent the stator for rotation in response to the rotating electromagnetic field, the rotor and stator providing first and second spaced-apart surfaces defining a pumping passage therebetween; and at least one helical thread disposed between the first and second surfaces and mounted to one of said surfaces, the thread having a rounded surface facing the other of said surfaces, wherein the rotor is sized relative to a selected working liquid such that, in use, the rotating rotor is radially supported relative to the stator substantially only by a layer of the liquid maintained between the rotor and stator by rotor rotation. Preferably rotor position is radially maintained substantially by a layer of the liquid between the rounded surface and the other of said surfaces which it faces.

In another aspect, the present invention provides a pump comprising a housing and a rotor rotatable relative to the housing, the rotor and housing defining at least a first flow path for a pump fluid, the rotor being axially slidable relative to the housing between a first position and a second position, the first position corresponding to a rotor axial position during normal pump operation, the second position corresponding to a rotor axial position during a pump inoperative condition, the rotor in the second position providing a second flow path for the fluid, the second flow path causing a reduced fluid pressure drop relative to the first flow path when the pump is in the inoperative condition. Preferably the second flow path is at least partially provided through the rotor. Preferably the first flow path is provided around the rotor.

In another aspect, the present invention provides a method of making a pump, comprising the steps of providing a housing, rotor, and at least one wire, winding the wire helically onto the rotor to provide a pumping member on the rotor, and fixing the wire to the rotor.

In another aspect, the present invention provides a pump for pumping a liquid, the pump comprising a rotor, and a stator, the stator including at least one electrical winding and at least one cooling passage, and a working conduit extending from a pump inlet to a pump outlet, working conduit in liquid communication with the cooling passage at at least a cooling passage inlet, such that in use a portion of the pumped liquid circulates through the cooling passage.

In another aspect, the present invention provides a pump comprising a rotor and working passage through which fluid is pumped and at least one feedback passage, the feedback passage providing fluid communication between a high pressure region of the pump to an inlet region of the pump. Preferably the feedback passage is provided through the rotor.

In another aspect, the present invention provides a pump comprising a rotor working passage through which liquid is pumped and at least one feedback passage, the rotor being disposed in the working passage and axially slidable relative thereto, the working passage including a thrust surface against which the rotor is thrust during pump operation, the feedback passage providing liquid communication between a high pressure region of the working passage and the thrust surface such that, in use, a portion of the pressurized liquid is delivered to form a layer of liquid between the rotor and thrust surface.

In another aspect the present invention provides an anti-icing system comprising a pump and a circulation network, wherein the pump is configured to generate heat in operation as a result of viscous shear in the pump liquid, the heat being sufficient to provide a pre-selected anti-icing heat load to the liquid.

Other advantages and features of the present invention will be disclosed with reference to the description and drawings.

BRIEF DESCRIPTION OF THE DRAWINGS

Reference will be now made to the accompanying drawings in which.

DETAILED DESCRIPTION OF THE PREFERRED EMBODIMENTS

Figure 1:
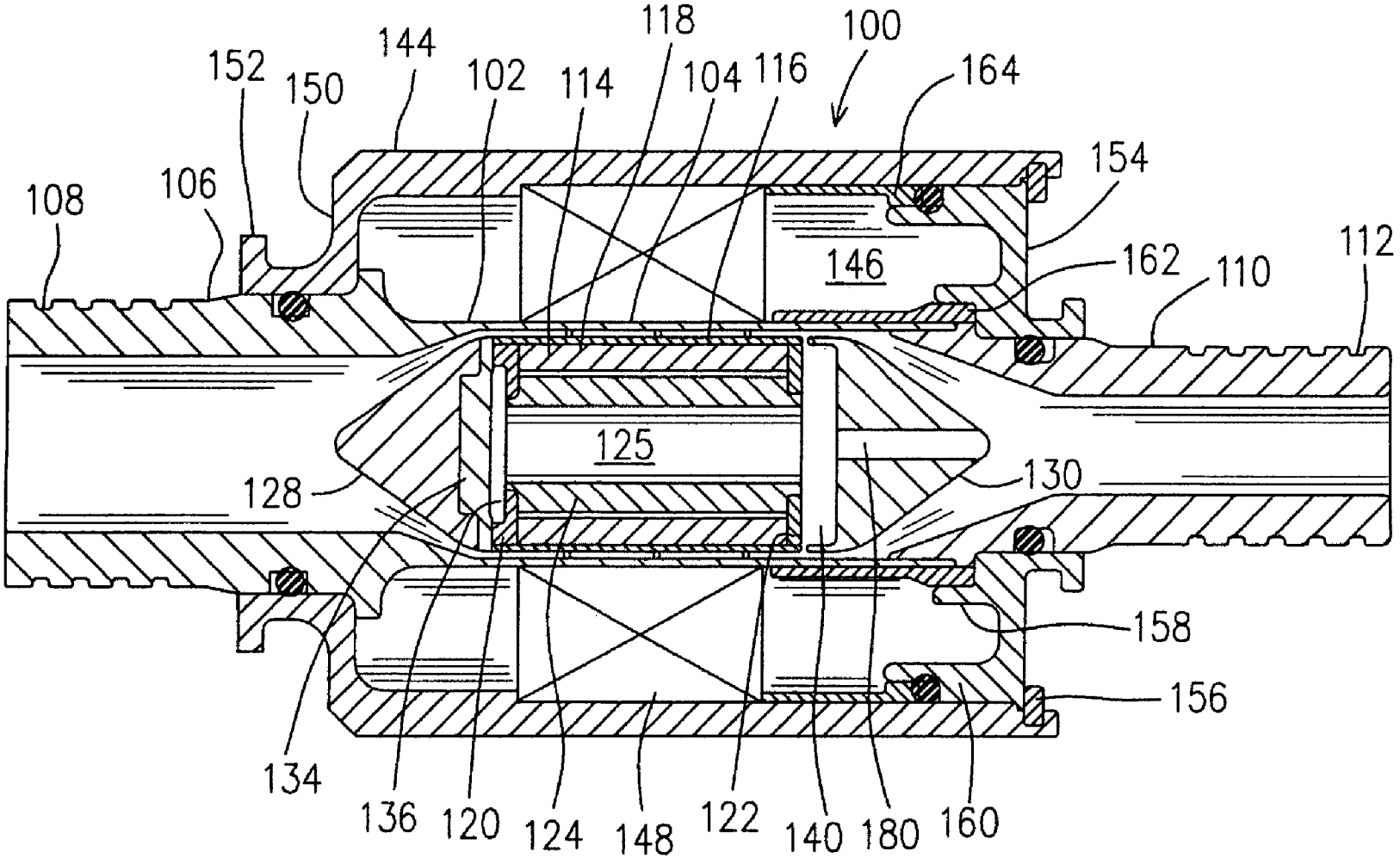
FIG. 1 is a cross-sectional view of a helix pump incorporating one embodiment of the present invention.
Figure 2:
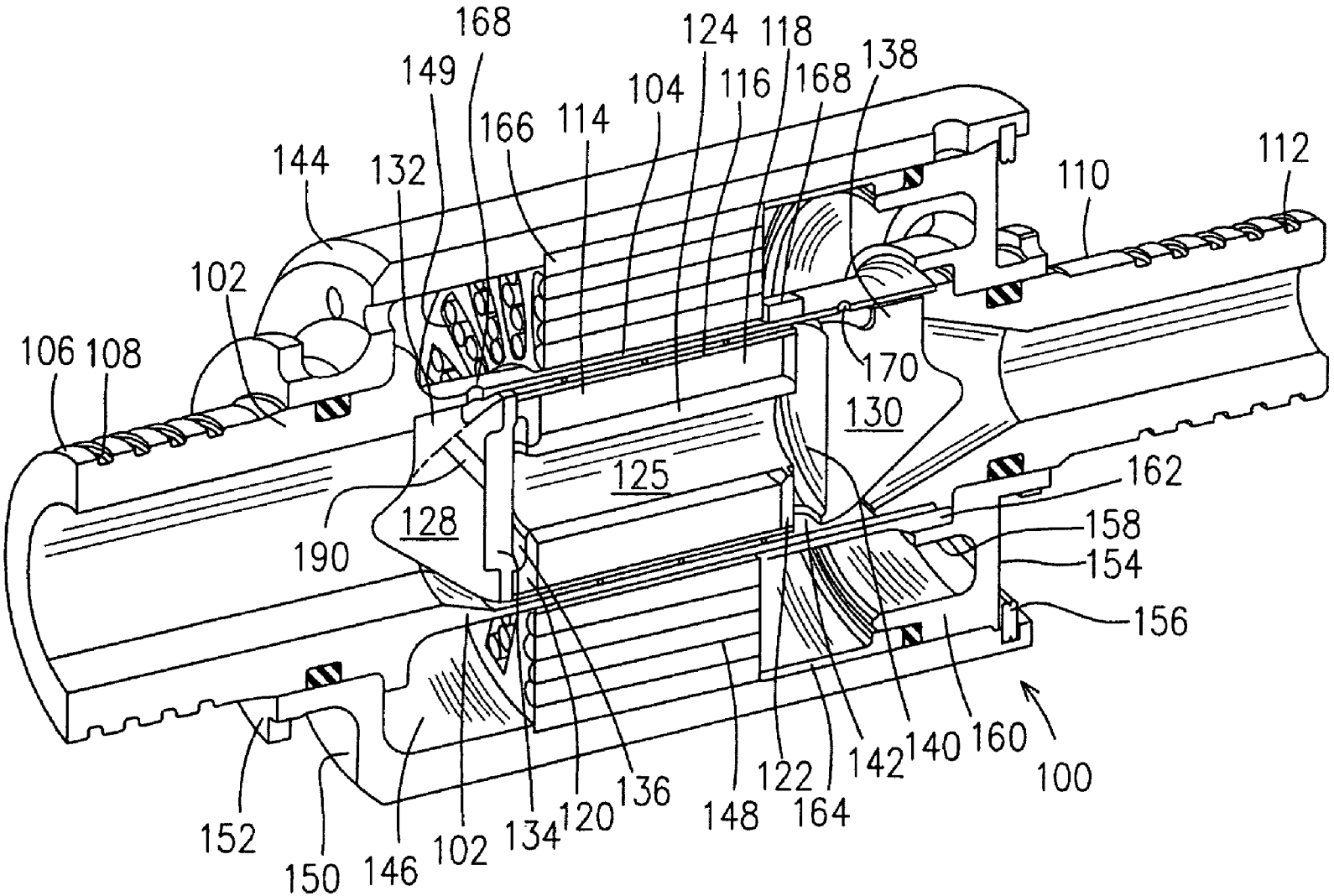
FIG. 2 is an isometric view of the embodiment of FIG. 1.
Figure 4:
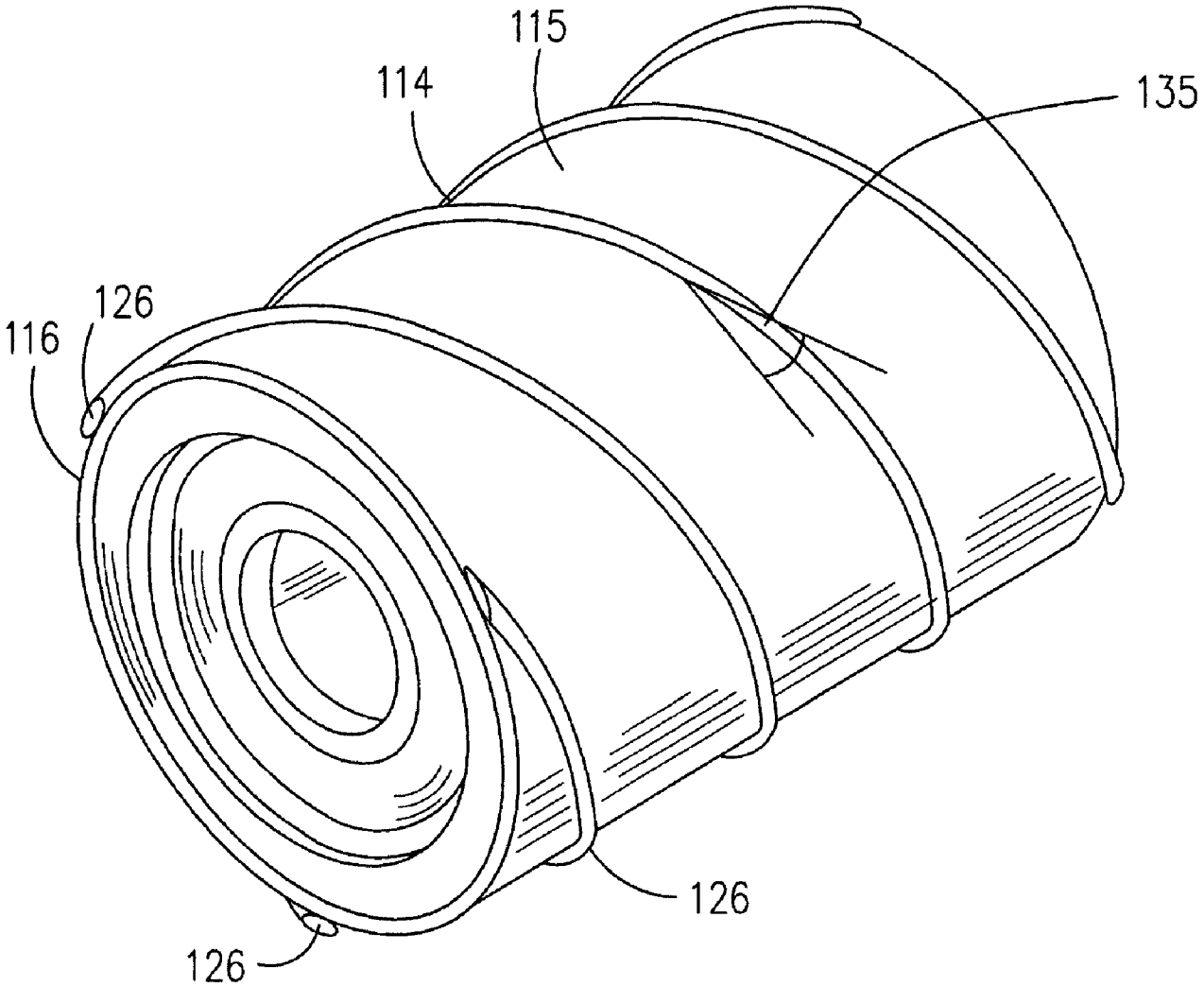
FIG. 4 is an isometric view of the rotor of FIG. 1.

Referring to FIGS. 1, 2 and 4, a helix pump, generally indicated at numeral 100, is provided according to one preferred embodiment of the present invention.

The helix pump 100 includes a cylindrical housing 102 having at one end a working conduit 104, a pump inlet 106, and pump outlet 110. The housing 102, or at least the working conduit 104 are made of non-metal material, for example, a plastic, ceramic or other electrically non-conductive material, so that eddy currents are not induced by the alternating magnetic field of the stator and rotor system. Preferably, in addition to being non-conductive, the inner wall of conduit 104 is smooth, and not laminated, to thereby provide sealing capability and low friction with the rotor, as will be described further below. Connection means, such as a plurality of annular grooves 108, are provided on pump inlet 106 for connection with an oil source such as an oil tank (not shown). The end of the working conduit 104 abuts a shoulder (not indicated) of a pump outlet 110 which preferably is positioned co-axially with the housing 102. The pump outlet 110 is also provided with connection means, such as a plurality of annular grooves 112 for connection to an oil circuit including, for example, engine parts for lubrication, cooling, etc. Any suitable connection means, such as a flanged connection, or force-fit connection, etc. may be used. Alternately, where the pump inlet and/or outlet is in direct contact with the working fluid (e.g. if the pump is submerged in a working fluid reservoir, for example), the inlet and/or outlet may have a different suitable arrangement.

A rotor 114 (cylindrical in this embodiment) is positioned within the working conduit 104, and includes a preferably relatively thin retaining sleeve 116, preferably made of a non-magnetic metal material, such as Inconel 718 (registered trade mark of for Inco Limited), titanium or certain non-magnetic stainless steels. The rotor 114 further includes at least one, but preferably a plurality of, permanent magnet(s) 118 within the sleeve 116 in a manner so as to provide a permanent magnet rotor suitable for use in a permanent magnet electric motor. The permanent magnets 118 are preferably retained within the sleeve 116 by a pair of non-magnetic end plates 120, 122 and an inner magnetic metal sleeve 124. A central passage 125 preferably axially extends through the rotor 114. The rotor 114 is adapted for rotation within the working conduit 104. The rotor 114 external diameter is sized such that a sufficiently close relationship (discussed below) is defined between the external surface 115 of the rotor 114 and the internal surface (not indicated) of the working conduit 104, which permits a layer of working fluid (in this case oil) in the clearance between the rotor and the conduit. As will be described further below, the clearance is preferably sized to provide a non-turbulent flow, and more preferably, to provide a substantially laminar flow in the pump. As will also be discussed further below, this is because the primary pumping effect of the invention is achieved through the application of a viscous shear force by thread 123 on the working fluid, which is reacted by the rotor 114 to move the working fluid tangentially and axially through the pump.

Figure 3B:
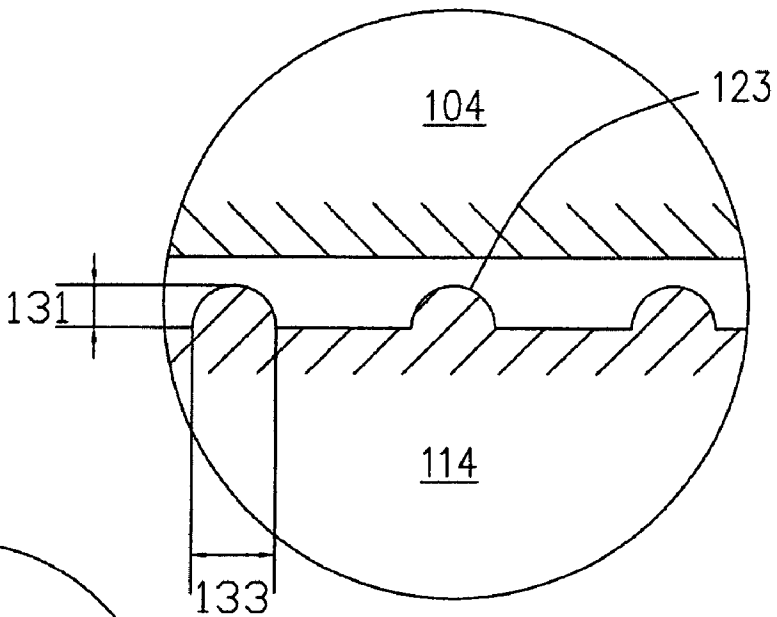
FIG. 3B is similar to FIG. 3A showing an another embodiment.
Figure 3C:
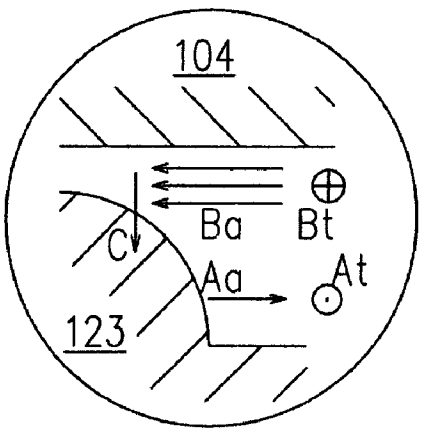
FIG. 3C is a further enlarged portion of FIG. 3A, schematically showing some motions and forces involved.
Figure 3A:
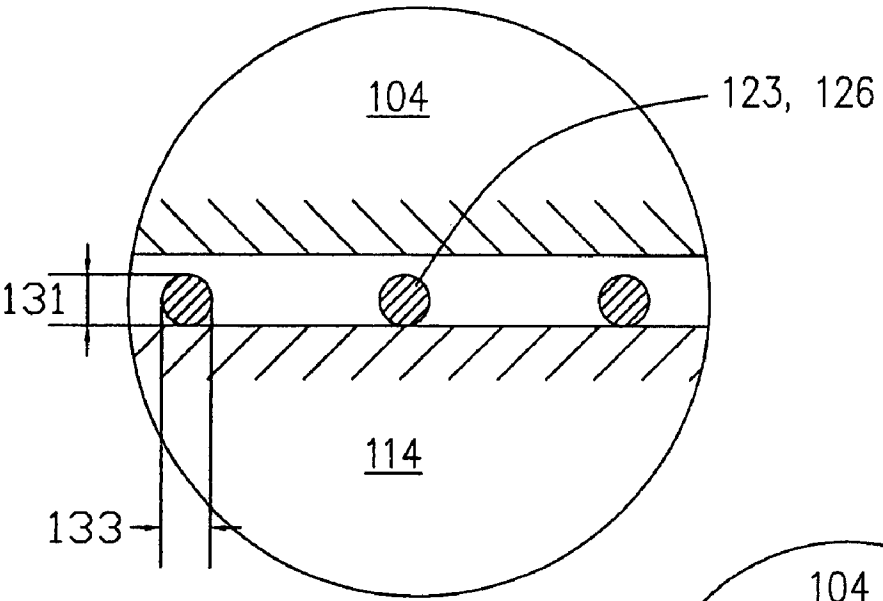
FIG. 3A is an enlarged portion of FIG. 1.

Referring to FIGS. 3A and 4, in this embodiment three threads 123 are provided, in this embodiment in the form of wires 126, each having a thread height 131, a thread width 133 a thread length (not indicated), and preferably a rounded outer surface or land 127, for reasons explained further below, such as that which is provided by the use of circular cross-sectioned wires 126. A thread surface area (not indicated), being the thread length times the thread width 133, represents the portion of the thread which is exposed directly to conduit 104, the significance of which will be discussed further below. The wires 126 may be made of any suitable material, such as metal or carbon fibre, nylon, etc. The wires 126 are preferably mounted about the external surface of the rotor 114 in a helix pattern, having a helix or thread angle 135, and circumferentially spaced apart from each other 120°. When rotated, the rotor 114 is dynamically radially supported within conduit 104 substantially only by a layer of the oil (the working fluid, in this example) between the rounded outer surface 127 of the thread 123 and the inner surface of the working conduit 104, as described further below. Rounded surface 127 preferably has a radius of about 0.008" or greater, but depends on pump size, speed, working liquid, etc. The threads 123, the outer surface of rotor 114 and the inner surface of working conduit 104 together define a plurality of oil passages which are preferably relatively shallow and wide. These shallow and wide oil passages provide for a thin layer of working fluid between rotor and conduit.

In accordance with the present invention, the number and configuration of the helical thread(s) 123 is/are not limited to the wires 126 described above, but rather any other suitable type and configuration of helical thread(s) may be used. For example, referring to FIG. 3B, a more fastener-like thread 123 may be provide in the form of ridge 129, having a rounded surface 127, on the operative surface of the rotor. Alternately, a thread 123 may be formed and then mounted to the rotor in a suitable manner. Any other suitable configuration may also be used.

Where the helical thread(s) are not integral with the rotor, they are preferably sealed to the rotor 114 to reduce leakage therebetween. For example, for wires 126 sealing is provided by welding or brazing, however other embodiments may employ an interference fit, other mechanical joints (e.g. adhesive or interlocking fit), friction fit, or other means to provide fixing and sealing. It will be understood that the mounting means and sealing means may vary, depend on the materials and configurations involved. Where extensible thread(s) are employed, such as wires 126, it is preferable to pre-tension it/them to also help secure position and reduce unwanted movement.

Axial translation of the cylindrical rotor 114 within conduit 104 is limited by an inlet core member 128 and the outlet core member 130, but rotor 114 is otherwise preferably axially displaceable therebetween (i.e. rotor 114 is axially shorter than the space available), as will be described further below. The non-rotating inlet core member 128 preferably has a conical shape for dividing and directing an oil inflow from the pump inlet 106 towards the space between the rotor 114 and the working conduit 104, and is preferably generally co-axially positioned within the housing 102 and mounted adjacent thereto by a plurality (preferably three) of generally radial struts 132 (only one of which is shown in FIG. 2). The struts 132 are circumferentially spaced apart to allow the oil to flow therepast and may also act as inlet guide vanes. The inlet core member 128 includes end plate 134 mounted adjacent the inner side thereof, forming an inlet end wall for contacting the end plate 120 of the rotor 114. The end plate 120 of the rotor 114 preferably has a central recess 136 to reduce the contacting area with the end plate 134, but perhaps more importantly, in use the recess 136 is allowed to fill with pressurized oil via the central passage 125, which helps balance the forces acting on rotor 114 and thereby reduce the axial load on the rotor 114 during the pump operation. End plate 134 and rotor 114 are configured to allow sufficient leakage therebetween, such that pressurized oil from central passage 125 may support rotor 114 in use in a manner similar to a thrust bearing. The struts 132 supporting the inlet core member 128 can also have a plurality of fluid supply passages 190 provided such that small jets of fluid may be directed from the pressurized liquid in central passage 125 (which has entered passage 125 through holes 142, described further below) toward the inlet end of the pump through the supporting struts 132, to promote an inlet fluid flow to the inlet of the pump, thereby improving the inlet conditions. Passages 125 and 190 thus provide a pressure feedback system.

Similar to the inlet core member 128, the non-rotating outlet core member 130 preferably has a conical shape for directing and rejoining the flow of oil from the space between the rotor 114 and the working conduit 104 into the pump outlet 110, and is preferably positioned generally co-axially with the housing 102 and the outlet 110. The outlet core member 130 is mounted adjacent the outlet 110 by a plurality (preferably three) of struts 138 (only one is shown in FIG. 2) which are circumferentially spaced apart to permit pumped oil to flow therepast. The outlet core member 130 also has a central recess 140 and a plurality of openings 142 (see FIG. 2) to provide fluid communication between the central recess 140 and the working conduit 104, for bypass purposes to be explained further below. The outlet core member 130 may also have a central hole 180 to provide an escape route or bleed for air or other gases that may otherwise be collected by centrifugal separation in the pumped fluid. In an alternate configuration (not shown) a conduit may also or instead be provided to evacuate the separated gas/air which collects at this location, and/or in other locations where separated gas/air may collect depending on pump configuration.

Figure 5:
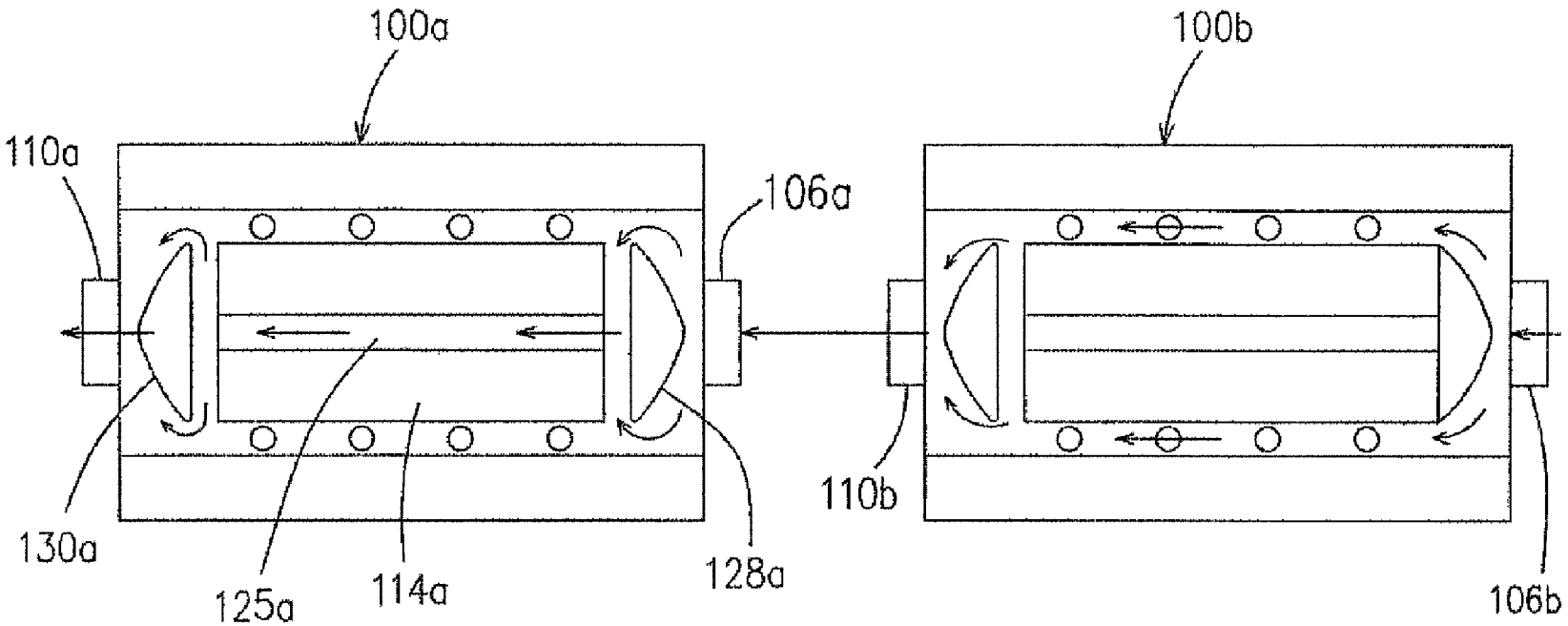
FIG. 5 is a schematic illustration of two pumps of the present invention connected in series.

In this embodiment, when the rotor 114 moves axially from adjacent the inlet core member 128 (i.e. as shown in FIGS. 1 and 2) towards the outlet core member 130, a gap opens between the rotor 114 and the inlet core member 128 (see FIG. 5). The central passage 125 of the rotor 114, the gap between the rotor 114 and the inlet core member 128 and the openings 142 in the outlet core member 130, therefore form a bypass assembly which will be discussed further below.

Referring again to FIGS. 1 and 2, casing 144 is provided around the housing 102 and the pump outlet 110, thereby forming a chamber 146 to accommodate a stator 148 therein. The casing 144 preferably includes an end wall 150 having a central opening (not indicated) for receiving the pump inlet 106. A mounting flange 152 is provided on the end wall 150. The casing 144 also has an open end closed by an end plate 154, which has a central opening for receiving the pump outlet 110, and is secured to the casing 144 by a retaining ring 156. The end plate 154 further includes inner and outer insert portions 158, 160 in cooperation with inner and outer retaining rings 162, 164 to restrain the axial position of the stator 148 in the annular chamber 146, in conjunction with integral shoulders (not indicated) on the casing inner side.

The stator 148 includes a plurality of electrical windings (not indicated), and preferably a retainer 166 which retains the electrical winding in position and provides cooling passages 149 extending therethrough. Coolant openings 168 and 170 (see FIG. 2) are provided at the opposing ends of the stator 148 and in fluid communication with the working conduit 104 to permit working fluid to be drawn therefrom for cooling purposes, described below. It is preferable to have the openings 170 at the outlet end smaller than the openings 168 at the inlet end, as described further below.

Rotor position information required for starting and running the permanent magnet motor is obtained from an appropriate sensor 168 preferably located in the stator 148, although rotor position sensing may be achieved through any suitable technique. The rotor 114 is preferably made longer than the stator 148 for positioning the position sensor 168, thus providing magnetic field at the end of the rotor for easy access by the position sensor.

Seals (not indicated) are provided on the interfaces between the casing 144 and pump inlet 106, between the casing 144 and the end plate 154, as well as between the end plate 154 and the pump outlet 110 to prevent leakage.

In use, when an AC current is supplied to the device, in conjunction with the rotor position data provided by the sensors, the electrical winding in the stator 148 generates an alternating electromagnetic field which results in appropriate rotation of the rotor 114, thereby driving the pump 100 into operation.

Preferably, as the rotor 114 rotates, a non- turbulent (i.e. about Re<10000) flow, and more preferably substantially laminar (i.e. about Re<5000) flow, and still more preferably fully laminar (i.e. about Re<2500) flow, is present between rotor 114 and working conduit 104. This is desired such that viscous effects of the liquid can be used to enhance pumping, as will now be described.

Referring to FIG. 3C, as the rotor 114 rotates in such non-turbulent conditions, the relative motion (which, due to thread angle 135, has axial and tangential component indicated by arrows $A_a$ and $A_t$, respectively, the arrow $A_t$ in this depiction pointing out of the plan of the page toward the reader) between thread 123 and the working fluid results in the generation of a viscous shear force in the oil and between the thread surface area of the thread 123 and the wall of working conduit 104. The viscous shear force acts to oppose relative movement between the thread and the working conduit—i.e. acts as a drag force in the direction of the thread angle 135—but may be resolved for analytical purposes into a tangential shear force (arrow $B_t$, directed into the plane of the page), and an axial shear force (indicated by arrow $B_a$). The reader will appreciate that this drag force increases as any one of the thread surface area, rotor speed, or viscosity increases, or the thread-to-conduit distance decreases. It will also be understood that the viscous forces generate corresponding viscous or drag pressures, as the viscous drag forces are applied to the liquid over an area. The areas involved in "useful" pressure development (i.e. the results in pumping pressure) are the gap or clearance height (between thread 123 and the conduit wall 104) times the projected thread length (i.e. for the tangentially directed pressure components, projected thread length would be more or less the axial length of the rotor, while for the axially directed pressure component, projected thread length would be more or less the circumference of the rotor). Expected or desired pressure may thus be calculated. However, the inventor has found that this viscous or drag pressure is only a useful pressure gain if an appropriate back pressure is applied to the pump outlet. If the back pressure applied is less then the drag pressure developed, then the drag pressure is simply results in lost efficiency, since that drag requires torque but does not result in pumping pressure gain. Therefore, back pressure is preferably applied at the pump outlet such that the back pressure is substantially equal to the viscous or drag pressure generated by rotor 114 rotation when pumping the desired liquid. The forces exerted on the liquid in the pump are primarily in the tangential direction (because this is the largest component of the rotor's velocity, because thread angles are typically less than 45 degrees) and, since the total pressure within the liquid must be balanced, the resulting liquid axial velocity must be such that, together with back pressure and axial shear pressures, the axial total pressure equals the tangential total pressure. Thus, in this manner the present invention provides a liquid pumping force. Unlike prior art screw or helix pumps, where friction and/or fluid dynamic lift is used to pump liquids, the threads of the present invention act somewhat more akin to windshield wipers, rather than fluid dynamic vanes, to develop tangential shear pressures which are subsequently resolved and balanced with back pressure to pump liquid from the device. Greater pressure and flow rates are thus possible than with the prior art devices.

In use, this viscous shear or drag tends to push the rotor 114 axially backward against the end plate 134 (thereby also beneficially closing the bypass assembly, as will be discussed further below). This load on the rotor is reacted by the end plate 134, as end plate 134, restrains any further axial motion of rotor 114, and thus the rotor 114 pushes back on the oil with a force substantially equal to the viscous shear or drag force, and it is this action which generates the primary pumping force of the present invention (in a direction opposite to arrows B).

As mentioned briefly above, conduit wall 104 is preferably smooth, to improve sealing capability for threads 123 relative to wall 104. The development of the viscous shear forces and pressures of the present invention is greatly enhanced by the provision of a smooth conduit wall. The prior art, such as U.S. Pat. No. 5,088,899 to Blecker et al, show that it is known to provide a working conduit of laminated steel—a common construction for motor stators, and since the motor stator doubles as a working conduit, it would seem natural to make the combination, and thus provide a laminated working conduit. The inventor has found, however, a laminated metal stator would not have the sealing capability or low friction characteristics preferred for desired implementation of the present invention.

As will be apparent, the designer may adjust many parameters in providing a pump according to the present invention having the desired pumping characteristics. Key considerations are the thickness of the shear film (i.e. between thread 123 and the wall 104), which affects the magnitude of the shear force and pressure for a given liquid, and the Reynolds number or "laminarity" of the flow, as adjusted by rotor speed, thread angle and thread surface area, the clearance between the rotor and the conduit, and liquid selection. The designer has many parameters at his disposal, including thread height, rotor-to-conduit clearance height, thread width, thread angle, thread length, number of threads on the rotor, rotor speed, back pressure, and liquid (i.e. to vary viscosity), to adjust these and other considerations in designing a pump according to the present invention.

The thread width is also instrumental in reducing leakage between the thread an conduit wall. Preferably, therefore, the thread width is optimized for drag and leakage.

Preferably, to generate maximum flow rates and pressures at high speeds, the clearance between the rotor and conduit and the thread height are made very small. The size, speed and pressures of the pump may vary, depending on the liquid pumped and pump configuration, etc. For example, the laminar nature of a flow is dependant upon scale, and a large diameter, low velocity rotor could have a much thicker thread and still remain in the non-turbulent or laminar regions.

The present invention also conveniently provides a bearing-less design. The rounded outer surface 127 co-operates with in the inner wall of working conduit 104, and with the small clearance between threads 123, rotor 114 and conduit 104, to create a hydrodynamic effect which generates pressure (indicated by arrow C in FIG. 3C) to create an oil wedge between the rounded outer surface of the helical thread. At higher rotational speeds, this pressure is sufficient to radially support the rotor 114 in a manner similar to the way in which an oil wedge supports a shaft within a journal bearing. The effect is affected by working liquid viscosity, and thus relative sizing of pump components should factor this consideration in, as well. This pump, therefore, does not require bearings of any sort (e.g. mechanical, magnetic, air, etc.) to support the rotor, although bearing support may be provided if desired.

An integral cooling system is also provided. During operation, the oil pressure at the outlet end is greater than the oil pressure at the inlet end, and this oil pressure differential causes oil to also enter the stator chamber 146 through the coolant inlet openings 170 and flow through cooling passages 149 in the stator to cool the electrical winding, and then exit from the coolant outlet openings 168. As mentioned, preferably inlet openings 170 (adjacent the pump outlet end) are smaller than outlet openings 168 to "meter" oil into the cooling passages at the high pressure end of the pump while allowing relatively un-restricted re-entrance of the oil to the working conduit 104 via the larger holes of outlet openings 168.

The present invention permits operation at large speed range, including very high speeds (e.g. ++10,000 rpm), providing that Reynolds number is maintained below about 10,000 between rotor and conduit, and more preferably 5000 and still more preferably below about 2500, as mentioned above. High speeds can permit the device to be made considerably smaller than prior art pumps having similar flow rates and pressures. The construction also permits better reliability (simple design, no bearings) and lower operating costs than the prior art.

Pump 100 of the present invention includes parts which are relatively easy to manufacture. Where wires 126 are used as threads, they can be mounted to the cylindrical rotor 114 by winding them thereonto in a helix pattern, preferably in a pre-tensioned condition, and the rotor 114 is then inserted into the working conduit 104 to thereby provide a pumping chamber between the rotor and the housing, and the end caps are put into place. This method of providing helical threads can be broadly applied to other types of pumps, not only to electrically driven pumps.

In one aspect, the present invention also permits the problems associated with large pressure drops caused by an inoperative pump in a multiple pump system to be simply addressed, as will now be described.

FIG. 5 schematically illustrates two helix pumps 100*a* and 100*b*, such that helix pump 100*a* has inlet 106*a* and outlet 110*b*, and helix pump 100*b* has inlet 106*b* and outlet 110*b*, according to the present invention in series. When pump 100*a* is inoperative, the pressure differential across the inoperative pump 100*a* is reversed relative to operative pump 100*b* (i.e. the oil pressure at the inlet 106*a* is greater than at the outlet 110*a*). The rotor 114*a* is thus forced towards the outlet core member 130*a* and leaves a gap between the rotor 114*a* and the inlet core member 128*a*. Although the rotor 114*a* axially abuts the outlet core member 130*a*, the openings 142 (see FIG. 2) in the outlet core member 130*a* provide a passage from the central passage 125*a* to the pump outlet 110*a*. Therefore, in this case, oil pumped by the operative pump 100*b* enters the pump inlet 106*a* of the pump 100*a* and a major portion of the oil is permitted to flow through the bypass passage formed by the central passage 125*a* through the inoperative pump 100*a*, thereby significantly reducing the pressure drop that would otherwise occur across the inoperative pump 100*a*.

In another application of the present invention, the helix pump of the present invention can be used, for example, as a boost pump located upstream of a fuel pump in a fuel supply line, for example as may be useful in melting ice particles which may form in the fuel in low temperatures. The viscous shear force generated by the pump of the present invention to move the working liquid, also results in heat energy which can be used to melt any ice particles in the fuel flow.

Figure 6:
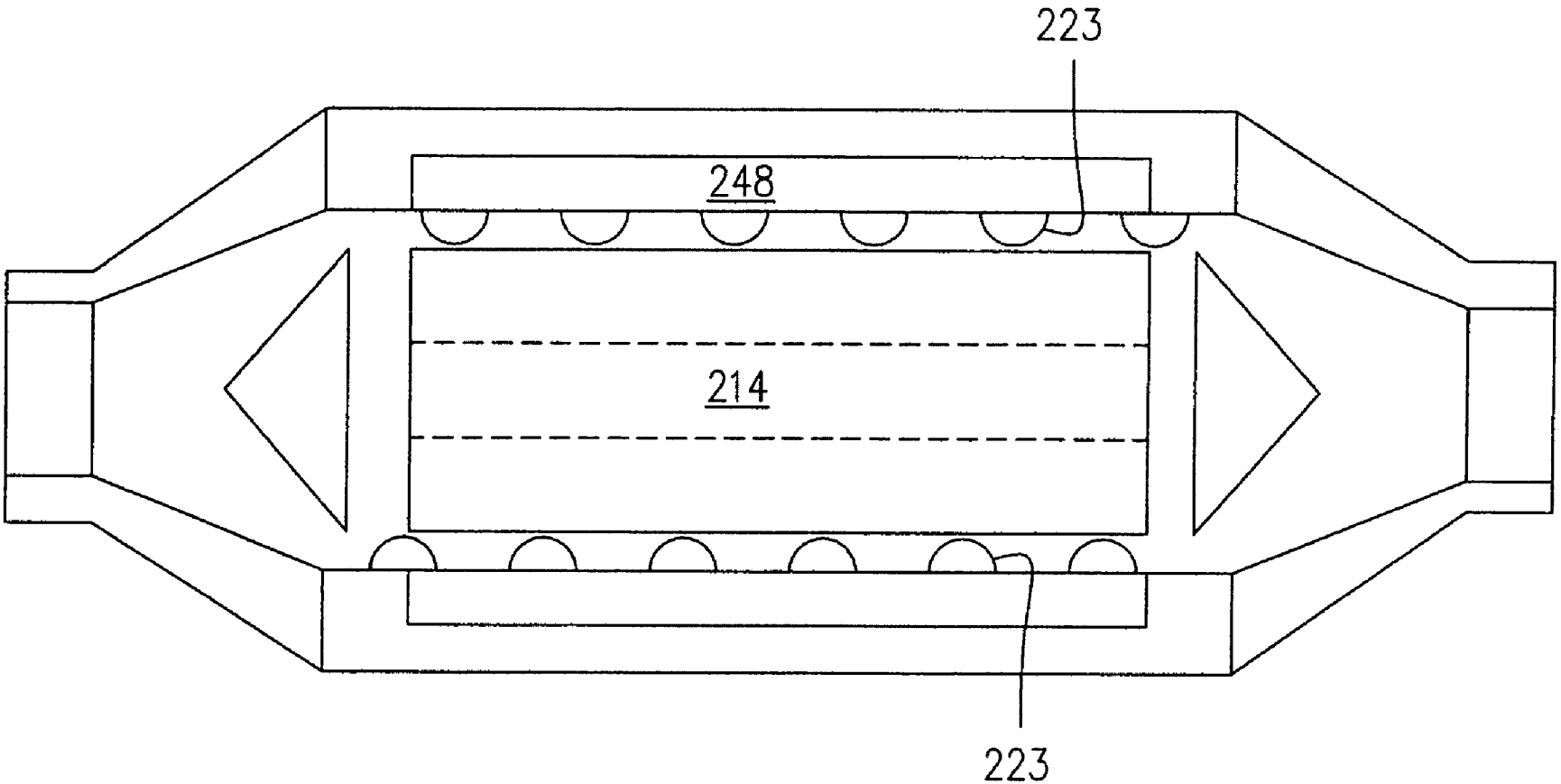
FIG. 6 is another embodiment according to the present invention.

It should be noted that modification of the described embodiments is possible without departing from the present teachings. For example, the invention may be used wherein the thread(s) is/are statically mounted to the stator, and a simple cylindrical rotor rotates therein, as depicted in FIG. 6, where elements analogous to those described above have similar reference numerals but are incremented by 200. Any other suitable combination or subcombination may be used. Also, the working medium may be any suitable liquid, such as fuel, water, etc. It should also be noted that the present concept may be applied to mechanically, hydraulically and pneumatically driven pumps, etc. The inoperative pump bypass feature is likewise applicable to other types of pumps, such as screw pumps, centrifugal pumps, etc. The bypass feature may be provided in a variety of configurations, and need not conform to the exemplary one described. Also, the pumped-medium stator cooling technique is applicable to other electrically driven pumps and fluid devices. Any suitable rotor and stator configuration may be used, and a permanent magnet and/or AC design is not required. The invention may be adapted to have an inside stator and outside rotor. Rounded surface 127 may have any radius or combination of multiple or compound radii, and may include flat or unrounded portions. The pressure feedback apparatus and bypass apparatus need not be provided by the same means, nor need they be provided in the rotor, not centrally in the rotor. The pump chamber(s) may have any suitable configuration: the inlets and outlets need not be axially aligned or concentrically aligned; the pumping chamber need not be a constant radius or annular; axial pumping may be replaced with centrifugal or other radial confirmation; the threads may not be continuous along the length of the rotor, but rather may be discontinuous with interlaced vanes; the threads may not be continuously helical; and still further modification will be apparent to the skilled reader and those listed here are not intended to be exhaustive. The scope of the present invention, rather, is intended to be limited solely by the scope of the claims.

The invention claimed is:

1. A pump for pumping a liquid comprising a pump rotor configured to rotate about an axis, an axial working passage through which liquid is pumped by the pump rotor and at least one feedback passage communicating with the axial passage, the axial passage extending axially relative to the axis from an inlet to an outlet, the pump rotor being rotatably disposed in the axial working passage between the inlet and the outlet and being axially slidable within the passage, the axial working passage including a thrust surface adjacent to the pump rotor on an inlet side of the pump rotor, the thrust surface extending substantially perpendicular to the axial working passage, the thrust surface configured to limit pump rotor axial movement toward the inlet by bearing an entirety of pump rotor thrust during pump rotor operation, the feedback passage providing liquid communication between a high pressure region of the axial working passage and a region between the pump rotor and the thrust surface at the passage inlet in order to permit a portion of the pressurized liquid to be delivered from the high pressure region to the region at the passage inlet.

2. The pump as defined in claim 1 wherein the pump rotor inlet side comprises a recess defined therein, the recess being fully filled with fluid in order to establish a back pressure, thereby reducing an axial load during pump rotor operation.

3. The pump as defined in claim 2 wherein the recess is cooperated with the thrust surface to provide a reservoir located correspondingly to a high pressure region of the liquid.

4. The pump as defined in claim 3 wherein the feedback passage has an inlet end disposed at the reservoir.

5. The pump as defined in claim 1 wherein the feedback passage comprises a plurality of fluid supply passages.

* * * * *